United States Patent [19]

Fineman

[11] 3,944,230

[45] Mar. 16, 1976

[54] CARD SHUFFLER

[76] Inventor: Sol Fineman, 440 Windsor S., Century Village, West Palm Beach, Fla. 33409

[22] Filed: June 23, 1975

[21] Appl. No.: 589,407

[52] U.S. Cl. ..... 273/149 R
[51] Int. Cl.[2] ..... A63F 1/12
[58] Field of Search ..... 273/149 R

[56] References Cited

UNITED STATES PATENTS

| | | | |
|---|---|---|---|
| 673,154 | 4/1901 | Bellows | 273/149 R |
| 2,615,719 | 10/1952 | Fonken | 273/149 R |
| 2,692,777 | 10/1954 | Miller | 273/149 R |

FOREIGN PATENTS OR APPLICATIONS

| | | | |
|---|---|---|---|
| 289,552 | 4/1928 | United Kingdom | 273/149 R |
| 430,504 | 5/1934 | United Kingdom | 273/149 R |

*Primary Examiner*—Anton O. Oechsle
*Attorney, Agent, or Firm*—Darby & Darby

[57] ABSTRACT

A card shuffler is disclosed comprising an inner case slidable in an outer case. The inner case has a plurality of separators that both divide the playing cards into portions of substantially equal number of cards and define compartments oriented at an angle to the direction the inner case slides in the outer case. The outer case has runners that hold the playing cards in the compartments when the inner case is fully disposed in the outer case but permit ejection of the cards, one card from each compartment simultaneously, as the inner case is slid out of the outer case.

11 Claims, 6 Drawing Figures

CARD SHUFFLER

FIELD OF THE INVENTION

The present invention is a card shuffler which automatically divides the pack into a plurality of substantially equal portions and recombines the playing cards in an order different from that in which the deck was originally arranged.

PRIOR ART

Prior art card shufflers have suffered from numerous faults, of which the principal fault is extreme complexity. Such complexity generally results in a device disproportionally expensive and overly sensitive to mechanical failures.

One prior art device is shown in Bellows, U.S. Patent 892,389. In this prior art device, a pack of playing cards is inserted into the top of the shuffler. A series of vertical separators divide the pack into smaller packs containing substantially equal number of cards. The deck comes to rest on a platform. The cards are ejected in a shuffled order by moving a plate upwards, which causes, through gears, wheels and levers, another plate, having a plurality of slots, each associated with a portion of the divided deck of playing cards, to move under the cards. As each slot moves under its respective portion of the deck of cards, a card at a time falls from each portion simultaneously into a composite pile to form a shuffled deck.

Lipps, U.S. Pat. No. 1,556,856, shows another card shuffler. Lipps, similar to Bellows, causes a plate containing a plurality of slots to pass below a divided deck of playing cards. Thus, Lipps also requires a complex arrangement of wheels and levers to properly move this plate. Additionally, Lipps requires another plate to properly separate the unshuffled deck of playing cards into portions of substantially equal number of cards before passing the shuffling plate below those portions. This adds further complexity.

Thus, it is an object of the present invention to obtain a mechanical card shuffler without unnecessary mechanical complexity.

It is another object to obtain a satisfactory shuffling of one or several decks of playing cards in one shuffling operation.

It is another object of this invention to obtain a mechanical card shuffler that divides an unshuffled deck into substantially equal parts without moving elements.

It is yet another object of the present invention to attain the foregoing objects in a simple, inexpensive and easily constructed device.

BRIEF SUMMARY OF THE INVENTION

The present invention is a card shuffler comprising a rectangular outer case and a rectangular inner case slidably disposed in the outer case. The inner case has a plurality of parallel separators which extend from side to side of the inner case and which divide the inner case into a series of compartments. The separators lie at an acute angle to the direction the inner case slides in the outer case.

A plurality of runners are provided in said outer case, equal in number to said compartments. Each runner is associated with one compartment, and is located and of such width that if the front and back surfaces of the compartment with which the runner is associated, when the inner case is fully inserted into the outer case, were extended towards said runner, they would both intersect the runner. Thus, when the inner case is fully inserted in the outer case, playing cards in the compartments are blocked from falling out of the compartment by the runners. When the inner case is slid out of the outer case, the front card in each compartment is forced towards the leading edge of the runner. Eventually, the leading card is forced over the leading edge of the runner and is ejected from the card shuffler.

BRIEF DESCRIPTION OF THE DRAWINGS

The foregoing and other objects, features and advantages of the invention will be apparent from the following more particular description of preferred embodiments of the invention, as illustrated in the accompanying drawings.

PREFERRED EMBODIMENT OF THE INVENTION

Figure 1:
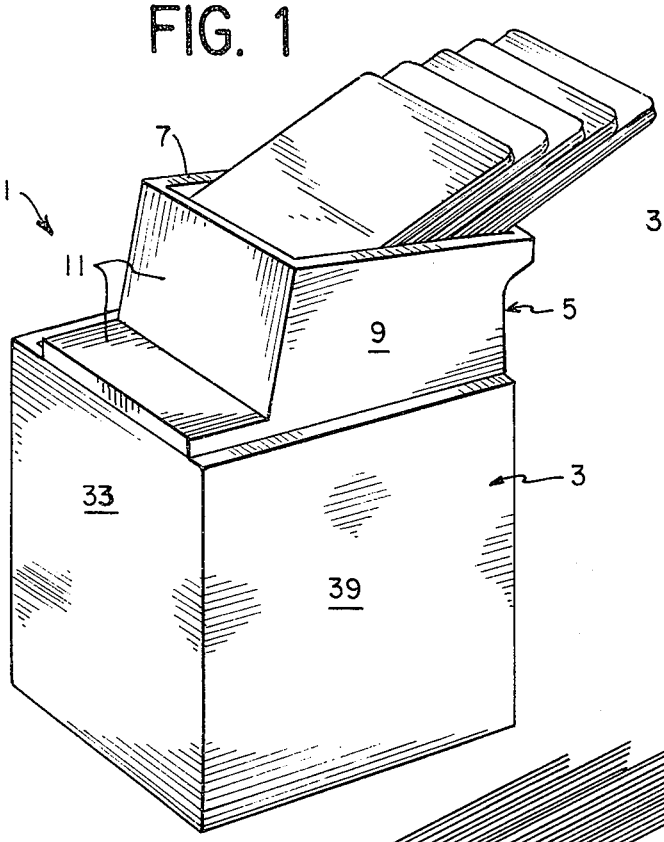
FIG. 1 is a perspective view of the card shuffler with an illustrative deck of cards inserted therein.

In FIG. 1, there is illustrated the preferred embodiment of the present invention. Card shuffler 1 comprises an outer rectangular case 3 and a substantially rectangular inner case 5. Inner case 5 is slidably disposed in outer case 3. The construction of inner case 5 can best be seen by referring to FIGS. 2 and 3. Inner case 5 comprises side walls 7 and 9, front wall 11 and back wall 13. Running from side wall 7 to side wall 9 are a plurality of separators 15. Separators 15 divide the interior of inner case 5 into a plurality of compartments 17. Each compartment is defined by a front surface 16 and rear surface 18.

Figure 2:
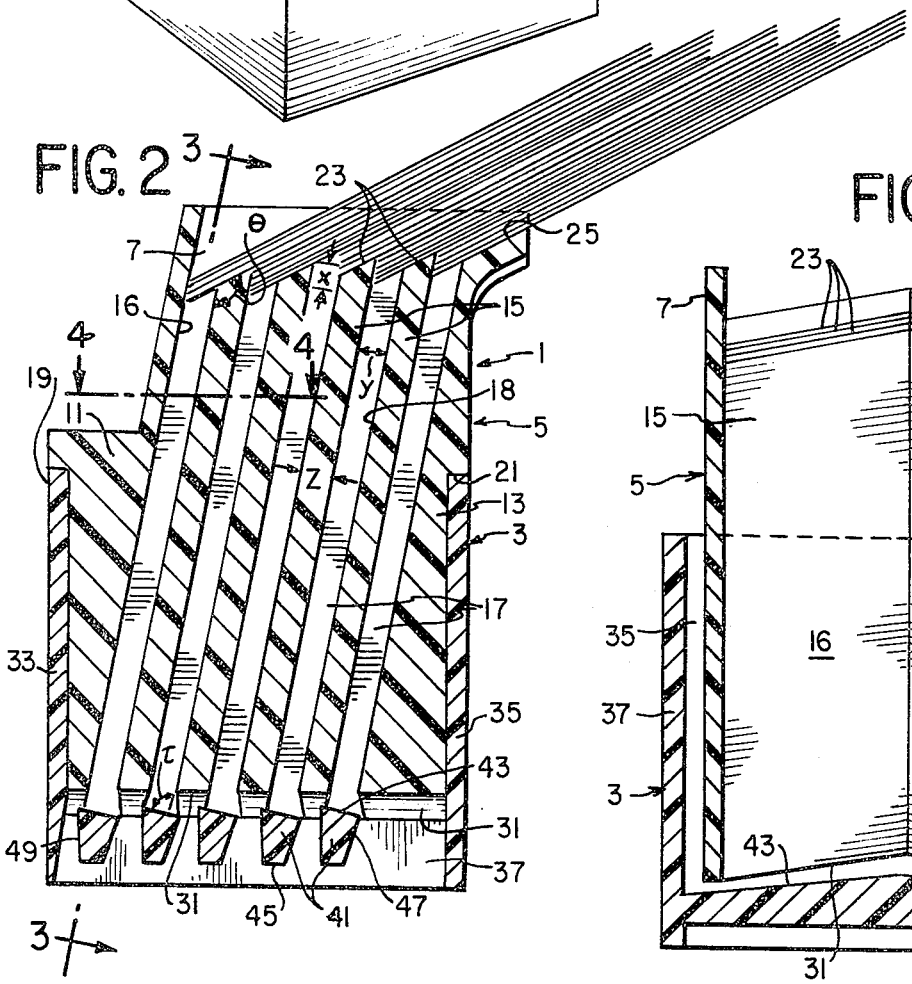
FIG. 2 is a cross-sectional side elevation of the card shuffler.

As evident from inspection of FIG. 2, separators 15 and interior surfaces of front wall 11 and back wall 13 are oriented at an acute angle to the direction in which inner case 5 slides in outer case 3. Also clearly shown in FIG. 2 is that the sliding movement of inner case 5 in outer case 3 is stopped in a downward direction when ledge 19 on front wall 11 and ledge 21 on back wall 13 of inner case 5 engage surfaces 20 and 22, respectively, of the front and back walls of outer case 3.

Also clearly illustrated in FIG. 2 is the means to separate the pack of cards into substantially equal portions. This means comprises a support surface 23 as the upper edge of each of the separators 15. Also, a support surface 25 is formed as the top edge of back wall 13. Support surfaces 23 and 25 are oriented at an angle $\theta$ greater than 90° to the surfaces 18 of separators 15. Additionally, if a line is drawn along support surface 23 to intersect front surface 16 of the compartment into which the cards fall from that particular support surface 26, the line will intersect front surface 16 a distance $X$ from the top of front surface 16. One skilled in the art will realize that, assuming that the topmost portions of separators 15 (i.e., front surface 16) lie in the same plane, the distance $X$ is dependent upon angle $\theta$ and distance $Y$, the distance between front surfaces 16 and rear surface 18 of a compartment, (i.e., the width of compartment 17). One skilled in the art will also recognize that if the pack of cards is to be divided into portions equal in number to the number of compartments 17, and each of these portions has a substantially equal number of playing cards, distance $X$ is given by the following formula:

$$X = \frac{T}{n}$$

where $n$ is the number of compartments 17 and $T$ is the thickness of the pack of cards.

Similarly, $\theta$ is defined by the following formula:

$$\theta = \cot^{-1} \frac{X}{Y}$$

where $\theta$ is the angle formed between support surface 23 and front surface 31 of separators 15, and $X$ and $Y$ are the distance defined above.

Naturally, the distance $Y$, the width of compartments 17, must be greater than $X$ or more cards will be selected for a particular compartment 17 than that compartment 17 can hold.

Figure 4:
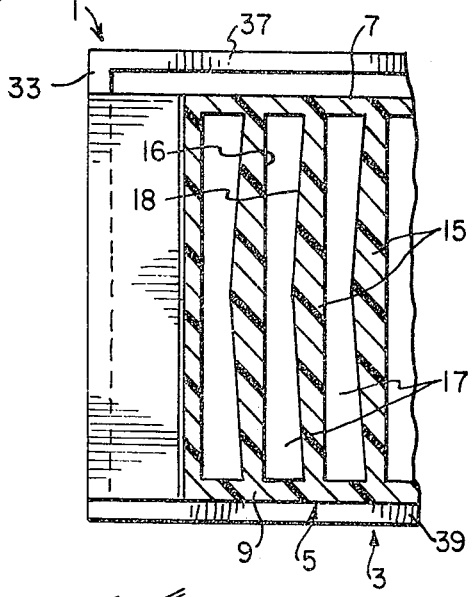
FIG. 4 is a partial cross-sectional view of the card shuffler along line 4—4 of FIG. 2.

Separators 15 have a number of other characteristics, principally prompted by the tendency of playing cards to assume a convex shape. Referring to FIG. 4, back surfaces 18 of compartments 17 are characterized by two intersecting planes meeting at the center of surface 18 without a sharp line of intersection. Measured at a short distance from the intersection, the planes form an obtuse angle. This particular surface shape is hereinafter termed "bi-planar."

Figure 3:
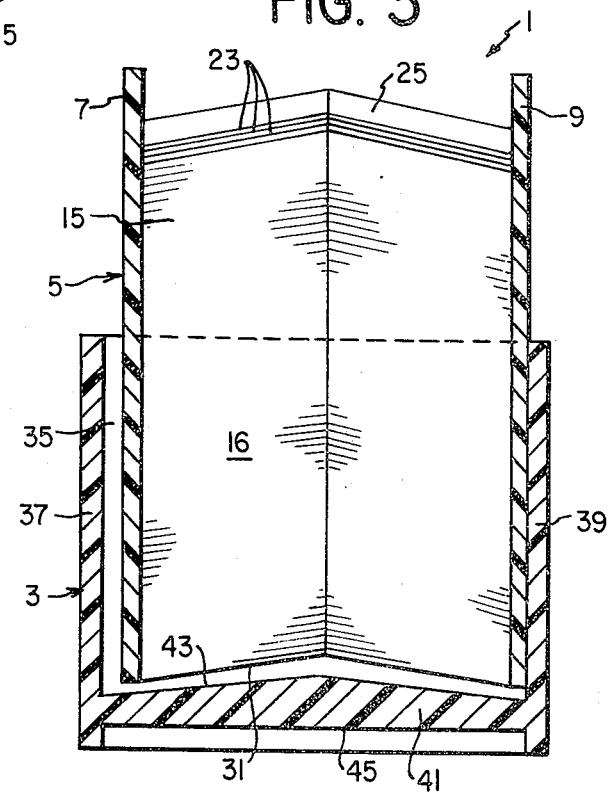
FIG. 3 is a cross-sectional view of the card shuffler along line 3—3 of FIG. 2.
Figure 5:
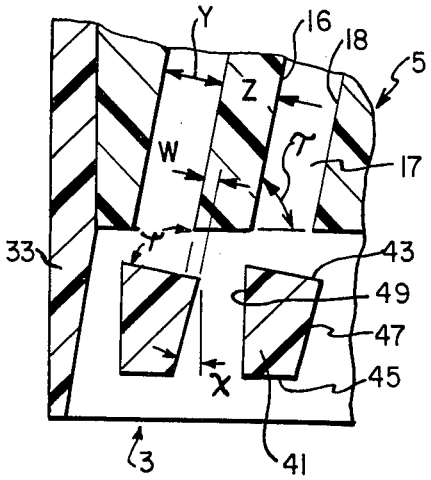
FIG. 5 is an enlarged view of one portion of FIG. 2.

Similarly, although not illustrated in FIG. 4, front surfaces 16 of compartments 17 could be bi-planar to match the convex surface of the playing card which it faces. Further, as shown in FIG. 3, support surfaces 23 are bi-planar to minimize obstruction to the playing cards as they fall from surface 25 against the topmost portions of surfaces 16. Lower edges 31 of separators 15 are also seen to be bi-planar. This surface and other accommodations to deformed playing cards are described below.

Outer case 3 has front wall 33, back wall 35 and side walls 37 and 39. Near the bottom of outer case 3 a plurality of runners 41 extend from side wall 37 to side wall 39. As shown in FIGS. 2 and 3, runners 41 are trapezoids having face 43, base 45 and legs 47 and 49. As shown in FIG. 2, face 43 is substantially perpendicular to the plane of front surface 16 and back surface 18. Face 43 has a width slightly greater than the depth $Y$ of compartments 17. Although in the preferred embodiment face 43 is substantially perpendicular to the plane of separators 15, other orientations could also be utilitarian. However, in either case, the width of face 43 is such that if front surface 16 and back surface 18 of a particular compartment 17 were extended towards runner 41 associated with that compartment 17, the extensions of both surfaces 16 and 18 would intersect face 43.

Face 43 is bi-planar and essentially is matched by bi-planar surface 31 of separators 15. Legs 47 and 49 of runners 41 slope toward each other as they approach base 45. Thus, runners 41 are closest to each other at faces 43; the clearance between runners 41 increases towards bases 45. A similar clearance is provided between runner 41, which is closest to front wall 33, and front wall 33 by notch 51 cut into the lower portion of front wall 33.

Bi-planar face 43 minimizes the contact between the playing cards and faces 43 and thus reduces the force needed to move the cards along faces 43. Lower edge 31 of separator 15 matches the bi-planar shape of face 43 which insures that the entire bottom edge of a playing card is supported by surface 18 of the compartment 17 in which the card is located. Thus, the cards are pushed (see below) at their lowest extremity to provide maximum force transmittal. The increasing clearance between runners 41 insures that when a playing card slips over the leading edge of runner 41, legs 47 and 49 do not interfere with the playing card's trajectory.

The preferred embodiment of the invention has a number of other features that augment its utility. As previously mentioned, inner case 5 is slidably disposed in outer case 3. As shown in FIG. 2, the fit between inner case 5 and outer case 3 as exemplified by the absence of space between front wall 33 and front wall 11 and back wall 35 and back wall 13, respectively, is rather tight. However, as shown in FIG. 3, there is a loose fit between inner case 5 and outer case 3 exemplified by the rather large space between side wall 37 and side wall 7 and side wall 39 and side wall 9, respectively. This loose tolerance permits inner case 5 to be shaken from side to side to aid ejection of the cards from the shuffler as described below.

As previously described, separators 15 lie at an acute angle to the direction inner case 3 slides in outer case 5. (Since there is a close tolerance between the respective front walls and back walls of inner case 5 and outer case 3, the direction that inner case 5 slides in outer case 3 is substantially constant.) In the preferred embodiment, this angle, herein termed $T$, although not critical, has been selected to be approximately 75°. Thus, if a playing card rested against the back surface 18 of a compartment 17 and against face 43 of a runner 41, then if inner case 5 was slid approximately 1 inch out of outer case 3, the playing card would move approximately one-fourth of an inch along face 43.

Also by way of illustration, the following dimensions are suggested for a shuffler according to the present invention for a pack of a thickness $T = 5/8$ inch.

| | |
|---|---|
| $\Gamma = 75°$ | $\psi = 87°$ |
| $\theta = 135°$ | $\chi = 30°$ |
| $Z = 3/16$ | $\tau = 75°$ |
| $Y = 3/16$ | $W = 1/16''$ |

OPERATION OF PREFERRED EMBODIMENT

Figure 6:
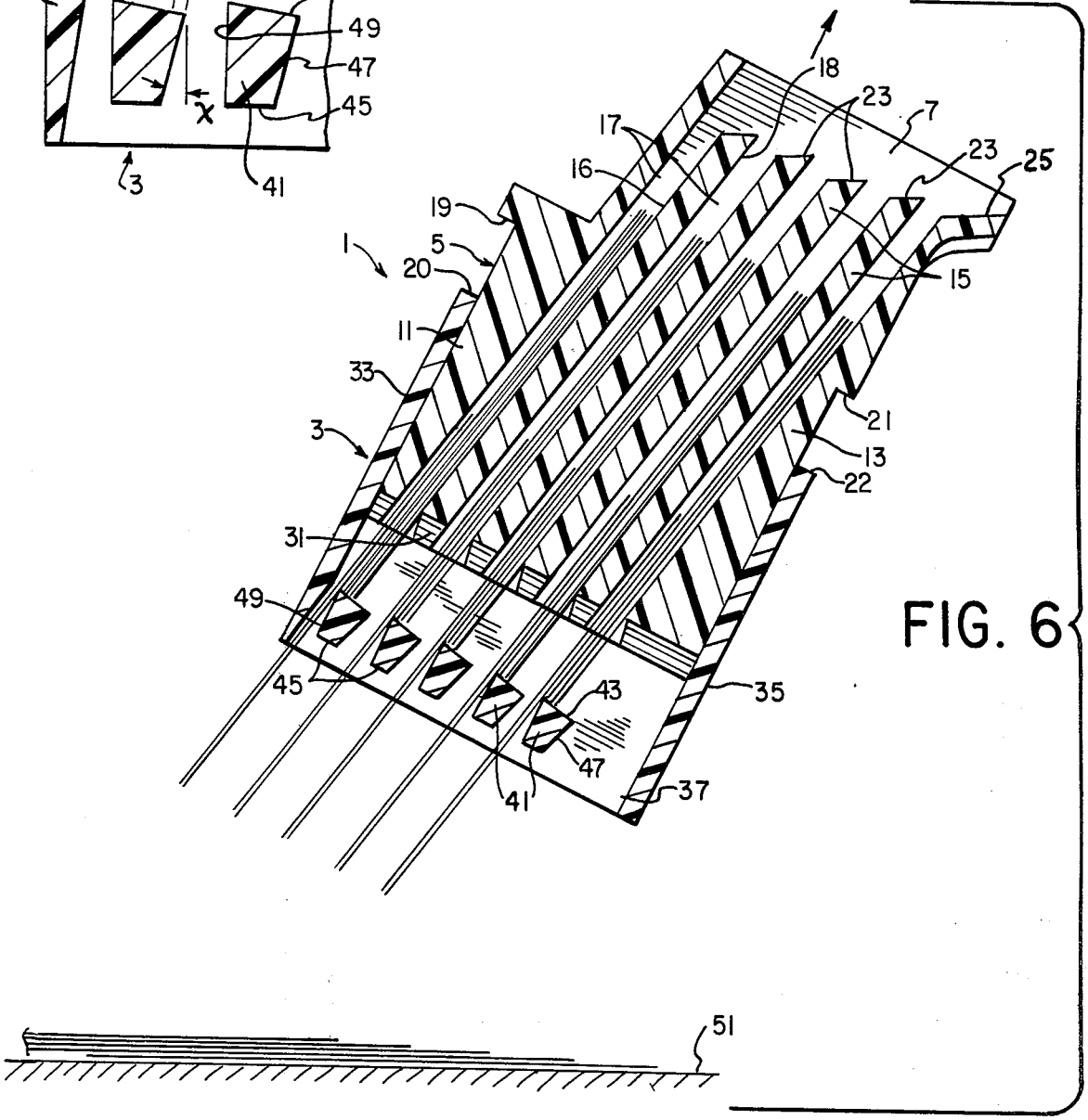
FIG. 6 is a side cross-sectional view of the card shuffler illustrating a particular moment during its operation.

FIGS. 1 and 6 illustrate the use of the preferred embodiment of the invention. Initially, card shuffler 1 rests on the table. A deck of playing cards is picked up, face down, and placed in a substantially horizontal position with the leading edge on support surface 25. The trailing edge of the pack of cards is then lifted until they are substantially parallel to support surface 25 (and the other support surfaces 23). The cards in the deck will slide down, until they strike the back surface 29 of one of separators 15 or front wall 11.

The deck is then lifted until it is substantially parallel to separators 15. A substantially equal number of cards will fall into each of compartments 17. The leading edge of the playing cards will strike and rest against faces 43 of runners 41.

Card shuffler 1 is then lifted from the surface of the table and held at approximately a 45° angle as shown in FIG. 6. While holding outer case 3 in one hand, the inner case 5 is slowly slid out of outer case 3. Simultaneously, inner case 5 can be shaken from side to side to promote the ejection of the playing cards. As inner case 5 moves out of outer case 3, back surface 18 of each of the compartments 17 forces the playing cards in compartment 17 forward, eventually causing the forwardmost card in compartment 17 over the forward edge of face 43. At substantially the same instant the first card (the card closest to front surface 16 of the respective compartments 17) from each of the compartments 17 will be ejected. Similarly, the remaining cards will be ejected from each of the compartments 17, one card at a time from each compartment 17 at substantially the same instant. The cards will fall onto the table surface 51.

In FIG. 6, the first card from each compartment 17 is shown as they landed on table surface 51. Also shown is the second card from each compartment in the process of being ejected from card shuffler 1. The remaining unshuffled playing cards are shown in their respective compartments 17.

While the invention has been particularly shown and described with reference to a preferred embodiment therof, it will be understood by those skilled in the art that the foregoing and other changes in form and details may be made therein without departing from the spirit and scope of the invention. For example, rather than using runners 41 as illustrated in the figures, a metal bottom may be supplied to outer case 3 having cutouts of proper placement and dimensions.

What is claimed is:

1. An apparatus for shuffling a deck of playing cards comprising:

an outer case;

an inner case slidably disposed in said outer case;

a plurality of parallel separators having top and bottom edges in said inner case dividing said inner case into a series of compartments having front and back surfaces, said separators lying at an acute angle to the direction said inner case slides in said outer case;

a plurality of runners in said outer case each associated with one of said compartments and located below said compartments when said inner case is fully inserted into said outer case;

said runners being of such a width that imaginary extensions of the front and back surfaces of a particular compartment extended towards the runner associated with that compartment would intersect that runner when said inner case is fully inserted into said outer case.

2. A card shuffler as in claim 1 including means to divide the pack of playing cards into substantially equal portions, said dividing means including:

said top edge of each of said separators having a surface that forms an angle with a surface of said compartments substantially greater than 90°, such that a line drawn along said top edge surface intersects the back surface of an adjacent separator a distance below the top edge equal to a $T$ divided by $n$, where $T$ is a thickness of the pack of cards and $n$ is the number of compartments.

3. A card shuffler as in claim 2 wherein the back surface of each of said compartments is substantially bi-planar.

4. A card shuffler as in claim 1 wherein said runners include an upper surface intersected by said imaginary extensions, said upper surfaces being bi-planar.

5. A card shuffler as in claim 2 wherein said top edge surface of each of said separators is substantially bi-planar.

6. A card shuffler as in claim 2 wherein the inner case can move in said outer case in only one additional direction, said additional direction being perpendicular to said sliding motion.

7. A card shuffler as in claim 4 wherein the bottom edge of said separator is of a bi-planar shape that is substantially the mirror image of the bi-planar shape of said runners.

8. A card shuffler comprising:

an outer rectangular case;

an inner rectangular case slidably disposed in said outer case;

a plurality of parallel separators in said inner rectangular case dividing said inner rectangular case into a series of compartments having front and back surfaces, said separators lying at an acute angle to the direction said inner rectangular case slides in said outer rectangular case;

a plurality of runners in said outer rectangular case, each of said runners:

located below one of said compartments, and having a bi-planar upper surface of orientation and width such that if imaginary extensions of the front and back surfaces of the compartment above the runner were extended toward the runner, they would intersect said upper surface at substantially right angles;

a bottom edge on each of said separators substantially parallel to the upper surface of said runner, said bottom edge being of a bi-planar shape that is substantially the mirror image of the bi-planar shape of the upper surface of said runners.

9. A card shuffler as in claim 8 wherein the bi-planar shape of all surfaces and edges is substantially the mirror image of the concavity or convexity of the surface or edge, respectively, of the playing card that rests or faces that particular surface or edge of the card shuffler.

10. An apparatus for shuffling a deck of playing cards comprising:

an outer case;

an inner case slidably disposed in said outer case;

a plurality of separators in said inner case dividing said inner case into a series of compartments having front and back surfaces, said separators lying at an acute angle to the direction said inner case slides in said outer case;

means for preventing the cards from falling out the bottom of said compartments when said inner case is fully inserted in said outer case and permitting said cards to fall out of said compartments, one card substantially simultaneously falling from each of said compartments, as said inner case is slid out of said outer case.

11. An apparatus as in claim 10 wherein said separators are substantially parallel to each other, and said preventing means comprise a runner associated with each compartment, said runner wider than the perpendicular distance between said front and back surfaces of said compartments.

* * * * *